US010794634B2

(12) United States Patent
Wei

(10) Patent No.: US 10,794,634 B2
(45) Date of Patent: Oct. 6, 2020

(54) MICROCHANNEL HEAT EXCHANGER WITH AN INWARD GAS/LIQUID DISTRIBUTION STRUCTURE

(71) Applicants: TRANE INTERNATIONAL INC., Davidson, NC (US); TRANE AIR CONDITIONING SYSTEMS (CHINA) CO., LTD., Taicang, Jiangsu (CN)

(72) Inventor: Dongbin Wei, Shanghai (CN)

(73) Assignees: TRANE AIR CONDITIONING SYSTEMS (CHINA) CO., LTD., Taicang (CN); TRANE INTERNATIONAL INC., Davidson, NC (US)

( * ) Notice: Subject to any disclaimer, the term of this patent is extended or adjusted under 35 U.S.C. 154(b) by 189 days.

(21) Appl. No.: 15/686,924

(22) Filed: Aug. 25, 2017

(65) Prior Publication Data

US 2018/0058763 A1 Mar. 1, 2018

(51) Int. Cl.

| | |
|---|---|
| ***F28D 7/00*** | (2006.01) |
| ***F28D 7/16*** | (2006.01) |
| ***F28D 1/047*** | (2006.01) |
| ***F28F 9/02*** | (2006.01) |
| *F28D 15/02* | (2006.01) |
| *F28F 1/42* | (2006.01) |

(52) U.S. Cl.

CPC ..... *F28D 7/1638* (2013.01); *F28D 1/0476* (2013.01); *F28F 9/0275* (2013.01); *F28D 7/0083* (2013.01); *F28D 15/0233* (2013.01); *F28F 1/424* (2013.01); *F28F 2260/02* (2013.01)

(58) Field of Classification Search

CPC ..... F28F 9/027; F28F 9/0273; F28F 9/0275; F25B 39/028

See application file for complete search history.

(56) References Cited

U.S. PATENT DOCUMENTS

2006/0070399 A1* 4/2006 Bae ..... F25B 39/02 62/504
2015/0047384 A1* 2/2015 Matter, III ..... F25B 13/00 62/324.6
2016/0010905 A1* 1/2016 Wang ..... F25B 39/028 62/190

FOREIGN PATENT DOCUMENTS

EP 2982924 A1 * 2/2016 ..... F25B 39/028

* cited by examiner

*Primary Examiner* — Eric S Ruppert
(74) *Attorney, Agent, or Firm* — Hamre, Schumann, Mueller & Larson, P.C.

(57) ABSTRACT

An inward gas/liquid distribution structure used in microchannel heat exchangers is disclosed. The inward gas/liquid distribution structure can help optimizing refrigerant distribution for a microchannel heat exchanger with long distribution pipe or a microchannel heat exchanger having significant wind field differences. The inward gas/liquid distribution structure includes an inlet header component. The inlet header component has n inlets that are configured to allow gas/liquid to enter the inlet header component, and "n" is an integer that is greater than or equal to 2. The inward gas/liquid distribution structure also includes m distribution components. The m distribution components are located in the inlet header component and connected to the n inlets, respectively. In an example, the number m equals to the number n.

6 Claims, 5 Drawing Sheets

MICROCHANNEL HEAT EXCHANGER WITH AN INWARD GAS/LIQUID DISTRIBUTION STRUCTURE

FIELD

This disclosure relates generally to microchannel heat exchangers. More specifically, the disclosure relates to a microchannel heat exchanger with an inward gas/liquid distribution structure that divides inward refrigerant flow into multiple portions.

BACKGROUND

A microchannel heat exchanger typically includes an inlet header, an outlet header, and a plurality of flat tubes connecting to and communicating with the headers. Each of the flat tubes has microchannels or small pathways for refrigerant (gas or liquid) to pass through. The working principles of microchannel heat exchangers are that refrigerant enters the inlet header via an inlet of the inlet header, then the refrigerant enters the flat tubes having microchannels, and the refrigerant conducts heat exchange with a fluid external to the flat tubes (e.g., air) to provide cooling or heating when the refrigerant flows within the flat tubes. Ideally, refrigerant should be evenly distributed to the microchannels of each of the flat tubes to provide an optimal operating efficiency of the microchannel heat exchanger. An even distribution of refrigerant is typically achieved by using conventional distribution pipes inside the inlet header.

SUMMARY

In some applications of a microchannel heat exchanger, a length of the microchannel heat exchanger is two thirds of the length of an enclosure that contains the microchannel heat exchanger, and a length of a fan casing is one third of the length of the enclosure. In other words, the microchannel heat exchanger is horizontally divided into two portions: a half of the microchannel heat exchanger is not covered by the fan casing, and the other half of the microchannel heat exchanger has fan casing coverage. Because of the fan casing coverage and the fan speed, a three-dimensional spatial pattern of winds (wind field) in the area of the microchannel heat exchanger that is covered by the fan casing is significantly different from the spatial pattern of winds in the area of the microchannel heat exchanger that is not covered by the fan casing. In an example, the length of the microchannel heat exchanger is at or about 39 inches (at or about 1 meter), which is relatively long compared with other refrigerant systems, e.g., heating, ventilation, and air conditioning (HVAC) systems. Accordingly, a length of the distribution pipe used in the header of the microchannel heat exchanger is relatively long. In particular optimization tests, for applications where the distribution pipe is long or where there are significant wind field differences between different areas of the microchannel heat exchanger, it was found difficult to obtain a distribution scheme with effective improvements.

A microchannel heat exchanger with a gas/liquid distribution structure is disclosed. The gas/liquid distribution structure can achieve distribution optimization for a relatively long microchannel heat exchanger and/or for a microchannel heat exchanger having significant wind field differences between different areas of the microchannel heat exchanger. Wind field differences are typically caused by, for example, fan speed, and can impact the effectiveness of heat exchange.

The microchannel heat exchanger with the gas/liquid distribution structure can be used in a refrigeration circuit such as, for example, in an HVAC system. In an embodiment, a HVAC system can be a rooftop unit or a heat pump air-conditioning unit. In an embodiment, the length of the microchannel heat exchanger in the refrigeration circuit can be at or about 39 inches (at or about 1 meter). In an embodiment, the scale of the refrigeration circuit can be, for example, at or over 10 tons. In an embodiment, the scale of the refrigeration circuit can be, for example, at or over 15 tons. In an embodiment, the scale of the refrigeration circuit can be, for example, at or about 10 to at or about 15 tons.

In an embodiment, a gas/liquid (e.g., refrigerant) distribution structure used in microchannel heat exchangers (e.g., evaporators) includes an inlet header component. The inlet header component has a number of (e.g., n) inlets configured to distribute refrigerant to different areas (e.g., tube sections) of the microchannel heat exchanger. The n inlets are configured to allow gas/liquid to enter the inlet header component, and "n" is an integer that is greater than or equal to 2. The gas/liquid distribution structure also includes a number of (e.g., m) distribution components configured to distribute the gas/liquid to each of the different areas of the microchannel heat exchanger, respectively. The m distribution components are located in the inlet header component and connected to the n inlets, respectively. In an example, the number "m" equals the number "n". However, it will be appreciated that m does not have to be equal to n.

In an embodiment, the inlet header component includes a first inlet header configured to distribute refrigerant to a front area of the microchannel heat exchanger and a second inlet header configured to distribute refrigerant to a back area of the microchannel heat exchanger. A first inlet is connected to a front end of the first inlet header. A second inlet is connected to a front end of the second inlet header. A first distribution component is provided within the first inlet header. A second distribution component is provided within the second inlet header.

In an embodiment, the first distribution component is a distribution pipe, and/or the second distribution component is a distribution pipe. In an embodiment, the distribution pipe is an elongate pipe extending in a length direction of the inlet header. The distribution pipe includes a plurality of small openings/holes. The distribution pipe is configured to evenly distribute refrigerant from the inlet header to the flat tubes that are in fluid communication with the inlet header. It will be appreciated that the first distribution component and/or the second distribution component can be any suitable distribution apparatus that achieves an even distribution of the refrigerant.

In an embodiment, an inlet header component includes a first inlet header and a second inlet header. A partition is provided in the first inlet header. The partition divides the first inlet header into a front part and a back part so that the front part and the back part are not in fluid communication with each other. A first inlet is connected to a front end of the first inlet header. The first inlet is in fluid communication with the front part of the first inlet header. A first distribution component is provided in the front part of the first inlet header. The first distribution component is configured to distribute the gas/liquid to a front area of the microchannel heat exchanger. The second inlet header fixedly connects to the back part of the first inlet header. A second inlet is connected to a front end of the second inlet header. The second inlet is in fluid communication with the back part of the first inlet header. In an embodiment, a second distribution component is provided between the second inlet header and the first inlet header. In an embodiment, the second distribution component is a connector. The second distribution component is configured to evenly distribute the gas/liquid to a back area of the microchannel heat exchanger.

In an embodiment, the second inlet header includes a plurality of distribution openings. In an embodiment, the plurality of distribution openings is sequentially arranged along a length of the second inlet header. In an embodiment, the plurality of distribution openings is sequentially arranged in a direction parallel to the length of the microchannel heat exchanger.

In an embodiment, the back part of the first inlet header includes a plurality of distribution openings. In an embodiment, the plurality of distribution openings is sequentially arranged along a length of the first inlet header. In an embodiment, the plurality of distribution openings is sequentially arranged in a direction parallel to the length of the microchannel heat exchanger.

In an embodiment, the plurality of distribution openings of the second inlet header and the plurality of distribution openings of the back part of the first inlet header are aligned with each other. In an embodiment, the second distribution component includes the plurality of distribution openings on the first inlet header and the plurality of distribution openings on the second inlet header.

In an embodiment, a microchannel heat exchanger includes a plurality of flat tubes arranged successively in a direction along a length of the microchannel heat exchanger. Each of the plurality of flat tubes has microchannels or small pathways for refrigerant (e.g., gas or liquid) to pass through. The microchannels have inlets and outlets. The microchannel heat exchanger also includes a gas/liquid distribution structure that is in communication with the inlet of each of the plurality of flat tubes. The microchannel heat exchanger further includes an outlet header that is in communication with the outlet of each of the plurality of flat tubes. The gas/liquid distribution structure includes an inlet header component. In an embodiment, the inlet header component has a number of (e.g., n) inlets configured to distribute refrigerant to different areas of the microchannel heat exchanger. The n inlets are configured to allow the gas/liquid to enter the inlet header component, and "n" is an integer that is greater than or equal to 2. In an embodiment, the inlet header component also includes a number for (e.g., m) distribution components configured to distribute the gas/liquid to each of the different areas of the microchannel heat exchanger, respectively. The m distribution components are located in the inlet header component and connected to the n inlets, respectively. In an example, the number "m" equals the number "n". However, it will be appreciated that m does not have to be equal to n.

In an embodiment, the inlet header component includes a first inlet header configured to distribute refrigerant to a front area of the microchannel heat exchanger and a second inlet header configured to distribute refrigerant to a back area of the microchannel heat exchanger. A first inlet is connected to a front end of the first inlet header. A second inlet is connected to a front end of the second inlet header. A first distribution component is provided within the first inlet header. A second distribution component is provided within the second inlet header. In an embodiment, the first distribution component and the second distribution component are distribution pipes.

In an embodiment, the first inlet header fixedly connects to the plurality of flat tubes located in the front area of the microchannel heat exchanger. In an embodiment, the second inlet header fixedly connects to the plurality of flat tubes located in the back area of the microchannel heat exchanger.

In an embodiment, an inlet header component includes a first inlet header and a second inlet header. A partition is provided in the first inlet header. The partition divides the first inlet header into a front part and a back part so that the front part and the back part are not in fluid communication with each other. In an embodiment, a first inlet is connected to a front end of the first inlet header. The first inlet is in communication with the front part of the first inlet header. A first distribution component is provided in the front part. The first distribution component is configured to distribute the gas/liquid to a front area of the microchannel heat exchanger. In an embodiment, the second inlet header fixedly connects to the back part of the first inlet header via a connector. A second inlet is connected to a front end of the second inlet header. The second inlet is in communication with the back part of the first inlet header. A second distribution component is provided and is configured to distribute gas/liquid to a back area of the microchannel heat exchanger.

In an embodiment, the first distribution component is a distribution pipe. In an embodiment, the connector includes a plurality of distribution openings, and the plurality of distribution openings is sequentially arranged along a length of the connector. In an embodiment, the plurality of distribution openings of the connector is sequentially arranged in a direction parallel to the length of the microchannel heat exchanger. In an embodiment, the second inlet header includes a plurality of distribution openings, and the plurality of distribution openings is sequentially arranged along a length of the second inlet header. In an embodiment, the plurality of distribution openings of the second inlet header is sequentially arranged in a direction parallel to the length of the microchannel heat exchanger. In an embodiment, the first inlet header includes a plurality of distribution openings, and the plurality of distribution openings is sequentially arranged along a length of the first inlet header. In an embodiment, the plurality of distribution openings of the first inlet header is sequentially arranged in a direction parallel to the length of the microchannel heat exchanger.

In an embodiment, the plurality of distribution openings of the connector, the plurality of distribution openings of the second inlet header, and the plurality of distribution openings of the back part of the first inlet header are aligned with each other. The second distribution component includes the plurality of distribution openings of the connector, the plurality of distribution openings of the second inlet header, and the plurality of distribution openings of the first inlet header. The second distribution component is a structure that allows refrigerant to flow from the second inlet header to the back part of the first inlet header and allows refrigerant to be evenly distributed from the back part of the first inlet header to the plurality of flat tubes located in the back area of the microchannel heat exchanger. It would be appreciated that in some embodiments, the connector may not be required.

In an embodiment, the first inlet header fixedly connects to every one of the plurality of flat tubes of the microchannel heat exchanger.

In an embodiment, a microchannel heat exchanger is disclosed. The microchannel heat exchanger includes a plurality of flat tubes, a refrigerant distribution structure, and an outlet header. The plurality of flat tubes is arranged successively in a direction along a length of the microchannel heat exchanger. Each of the plurality of flat tubes includes microchannels. The plurality of flat tubes includes inlets and outlets. The inlets of the plurality of flat tubes are in fluid communication with the outlets of the plurality of flat tubes through the microchannels of the plurality of flat tubes. The outlet header is in fluid communication with outlets of the plurality of flat tubes. The plurality of flat tubes is divided into a first part of flat tubes and a second part of flat tubes. The refrigerant distribution structure includes a first inlet header and a second inlet header. The first inlet header is in fluid communication with inlets of the first part of flat tubes. The second inlet header is in fluid communication with inlets of the second part of flat tubes. The refrigerant distribution structure further includes a first inlet, a second inlet, a first distribution component, and a second distribution component. The first inlet of the refrigerant distribution structure is in fluid communication with the first inlet header and the first distribution component. The second inlet of the refrigerant distribution structure is in fluid communication with the second inlet header and the second distribution component.

In an embodiment, a method of directing refrigerant in a microchannel heat exchanger is disclosed. The microchannel heat exchanger includes a plurality of flat tubes, a refrigerant distribution structure, and an outlet header. The plurality of flat tubes includes inlets and outlets, the plurality of flat tubes is divided into a first part of flat tubes and a second part of flat tubes. The refrigerant distribution structure includes a first inlet header, a second inlet header, a first inlet, a second inlet, a first distribution component, and a second distribution component. The first distribution component is located in the first inlet header. The method includes dividing refrigerant into a first portion and a second portion. The method also includes directing the first portion of the refrigerant from the first inlet of the refrigerant distribution structure to the first distribution component in the first inlet header. The method further includes distributing the first portion of the refrigerant from the first distribution component to the inlets of the first part of flat tubes. Also the method includes directing the first portion of the refrigerant from the inlets of the first part of flat tubes to the outlets of the first part of flat tubes. In addition, the method includes directing the second portion of the refrigerant from the second inlet of the refrigerant distribution structure to the second distribution component. Further, the method includes distributing the second portion of the refrigerant from the second distribution component to the inlets of the second part of flat tubes. Moreover, the method includes directing the second portion of the refrigerant from the inlets of the second part of flat tubes to the outlets of second part of flat tubes. The method also includes directing the first portion and the second portion of the refrigerant from the outlets of the first part and the second part of flat tubes to the outlet header.

In an embodiment, the first inlet header is not in fluid communication with the second inlet header.

In an embodiment, the first inlet header is divided into a first part and a second part via a partition. The first part of the first inlet header is not in fluid communication with the second inlet header. The second part of the first inlet header is in fluid communication with the second inlet header.

In an embodiment, a method of retrofitting existing microchannel heat exchanger is disclosed. The existing microchannel heat exchanger includes an outlet header and a first inlet header. The method includes adding a partition inside the first inlet header. The partition divides the first inlet header into a first part and a second part so that the first part is not in fluid communication with the second part. Also the method includes making a plurality of distribution openings on the second part of the first inlet header. The method further includes providing a second inlet header with a plurality of distribution openings. Further, the method includes connecting the second inlet header onto the second part of the first inlet header to allow refrigerant to flow from the second inlet header via the plurality of distribution openings on the second inlet header and the plurality of distribution openings on the second part of the first inlet header into the second part of the first inlet header. In an embodiment, connecting is welding.

In an embodiment, the method of retrofitting a microchannel heat exchanger also includes providing an interface connector with a plurality of distribution openings. In an embodiment, connecting the second inlet header onto the second part of the first inlet header includes connecting a first side of the interface connector onto the second inlet header. In an embodiment, connecting the second inlet header onto the second part of the first inlet header also includes connecting a second side of the interface connector onto the second part of the first inlet header to allow refrigerant to flow from the second inlet header via the plurality of distribution openings on the second inlet header, the plurality of distribution openings on the interface connector, and the plurality of distribution openings on the second part of the first inlet header into the second part of the first inlet header. In an embodiment, connecting is welding.

In an embodiment, the method of retrofitting a microchannel heat exchanger further includes disconnecting the inlet from the first inlet header. The method also includes providing a first inlet and connecting the first inlet to the first inlet header so that the first inlet is in fluid communication with the first inlet header. Moreover, the method includes providing a second inlet and connecting the second inlet to the second inlet header so that the second inlet is in fluid communication with the second inlet header. Further, the method includes connecting the inlet to the first inlet and the second inlet to allow a first portion of refrigerant to flow from the inlet to the first inlet and a second portion of refrigerant to flow from the inlet to the second inlet.

In an embodiment, the step of connecting the second inlet to the second inlet header includes connecting the second inlet to an extension pipe so that the second inlet is in fluid communication with the extension pipe. The step also includes connecting the extension pipe to the second inlet header so that the extension pipe is in fluid communication with the second inlet header.

The microchannel heat exchanger with a gas/liquid distribution structure has the following advantages compared with existing technologies: the distribution of refrigerant flow can be divided into multiple portions, the distribution optimization can be localized for each portion, and the difficulty/complexity of the distribution optimization can be reduced. The microchannel heat exchanger having areas with significant wind field differences can be divided into multiple parts, the distribution of refrigerant for each part can be done via independent distribution components respectively, and the design of refrigerant distribution can be optimized locally for each distribution component. The refrigerant flow can be adjusted or controlled locally for each distribution component to optimize performance.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTIONS

Some embodiments of the present application are described in detail with reference to the accompanying drawings so that the advantages and features of the present application can be more readily understood by those skilled in the art. The terms "front" and "back" and the like described in the present application are defined according to the typical observation angle of a person skilled in the art and for the convenience of the description. These terms are not limited to specific directions. For example, for FIG. 2, "front" can correspond to the left side of the paper, and "back" can correspond to the right side of the paper.

Figure 1:
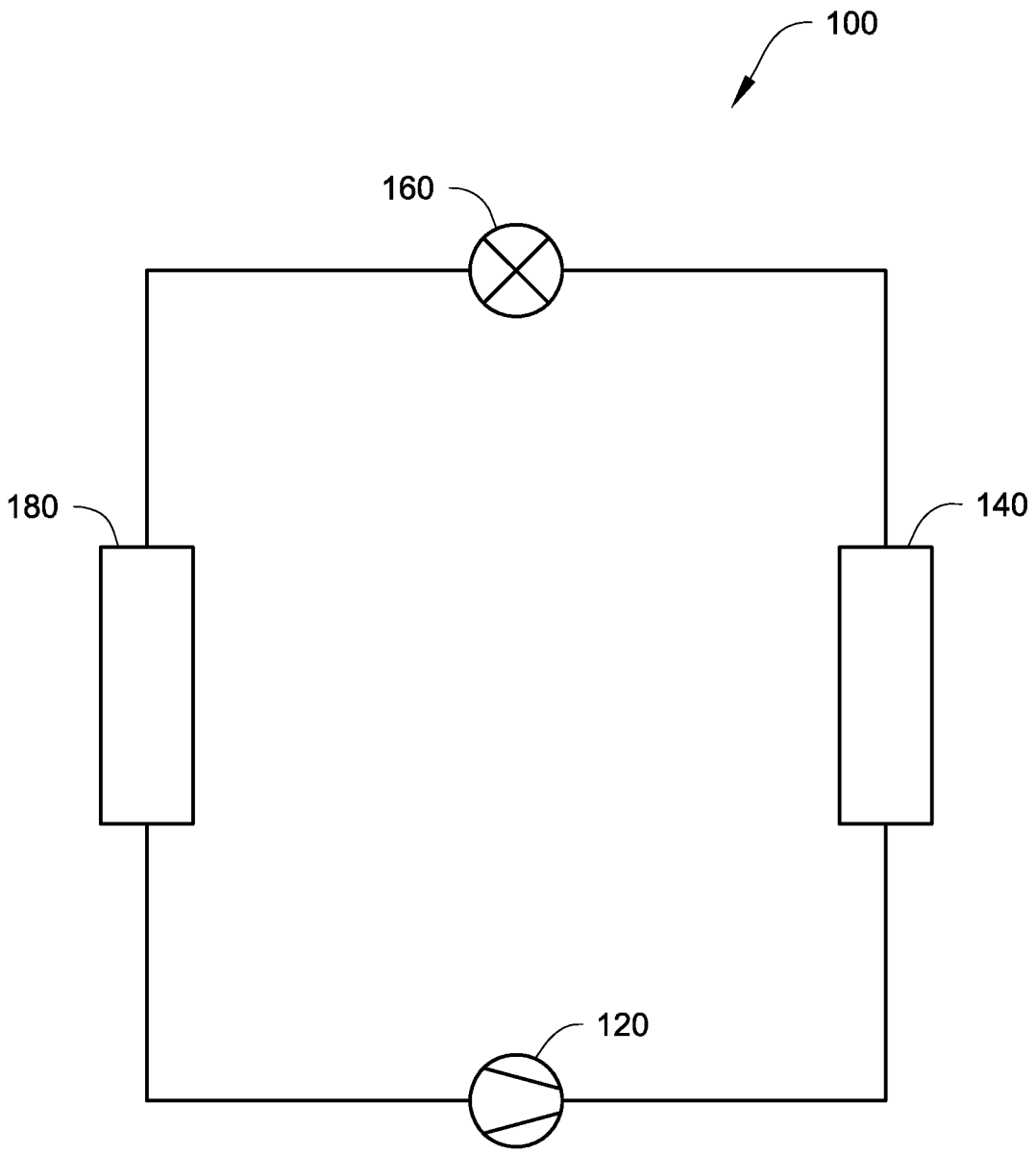
FIG. 1 is a schematic diagram of a refrigeration circuit, according to an embodiment.

FIG. 1 is a schematic diagram of a refrigerant circuit 100, according to an embodiment. The refrigerant circuit 100 generally includes a compressor 120, a condenser 140, an expansion device 160, and an evaporator 180. In an embodiment, the evaporator 180 can be a microchannel heat exchanger. The refrigerant circuit 100 is an example and can be modified to include additional components. For example, in an embodiment, the refrigerant circuit 100 can include other components such as, but not limited to, an economizer heat exchanger, one or more flow control devices, a receiver tank, a dryer, a suction-liquid heat exchanger, or the like.

The refrigerant circuit 100 can generally be applied in a variety of systems used to control an environmental condition (e.g., temperature, humidity, air quality, or the like) in a space (generally referred to as a conditioned space). Examples of such systems include, but are not limited to, HVAC systems, transport refrigeration systems, or the like. In an embodiment, a HVAC system can be a rooftop unit or a heat pump air-conditioning unit.

The compressor 120, condenser 140, expansion device 160, and evaporator 180 are fluidly connected. In an embodiment, the refrigerant circuit 100 can be configured to be a cooling system (e.g., an air conditioning system) capable of operating in a cooling mode. In an embodiment, the refrigerant circuit 100 can be configured to be a heat pump system that can operate in both a cooling mode and a heating/defrost mode.

The refrigerant circuit 100 can operate according to generally known principles. The refrigerant circuit 100 can be configured to heat or cool a liquid process fluid (e.g., a heat transfer fluid or medium (e.g., a liquid such as, but not limited to, water or the like)), in which case the refrigerant circuit 100 may be generally representative of a liquid chiller system. The refrigerant circuit 100 can alternatively be configured to heat or cool a gaseous process fluid (e.g., a heat transfer medium or fluid (e.g., a gas such as, but not limited to, air or the like)), in which case the refrigerant circuit 100 may be generally representative of an air conditioner or heat pump.

In operation, the compressor 120 compresses a working fluid (e.g., a heat transfer fluid (e.g., refrigerant or the like)) from a relatively lower pressure gas to a relatively higher-pressure gas. The relatively higher-pressure gas is also at a relatively higher temperature, which is discharged from the compressor 120 and flows through the condenser 140. In accordance with generally known principles, the working fluid flows through the condenser 100 and rejects heat to the process fluid (e.g., water, air, etc.), thereby cooling the working fluid. The cooled working fluid, which is now in a liquid form, flows to the expansion device 160. The expansion device 160 reduces the pressure of the working fluid. As a result, a portion of the working fluid is converted to a gaseous form. The working fluid, which is now in a mixed liquid and gaseous form flows to the evaporator 180. The working fluid flows through the evaporator 180 and absorbs heat from the process fluid (e.g., a heat transfer medium (e.g., water, air, etc.)), heating the working fluid, and converting it to a gaseous form. The gaseous working fluid then returns to the compressor 120. The above-described process continues while the heat transfer circuit is operating, for example, in a cooling mode (e.g., while the compressor 120 is enabled).

Embodiment 1

Figure 2:
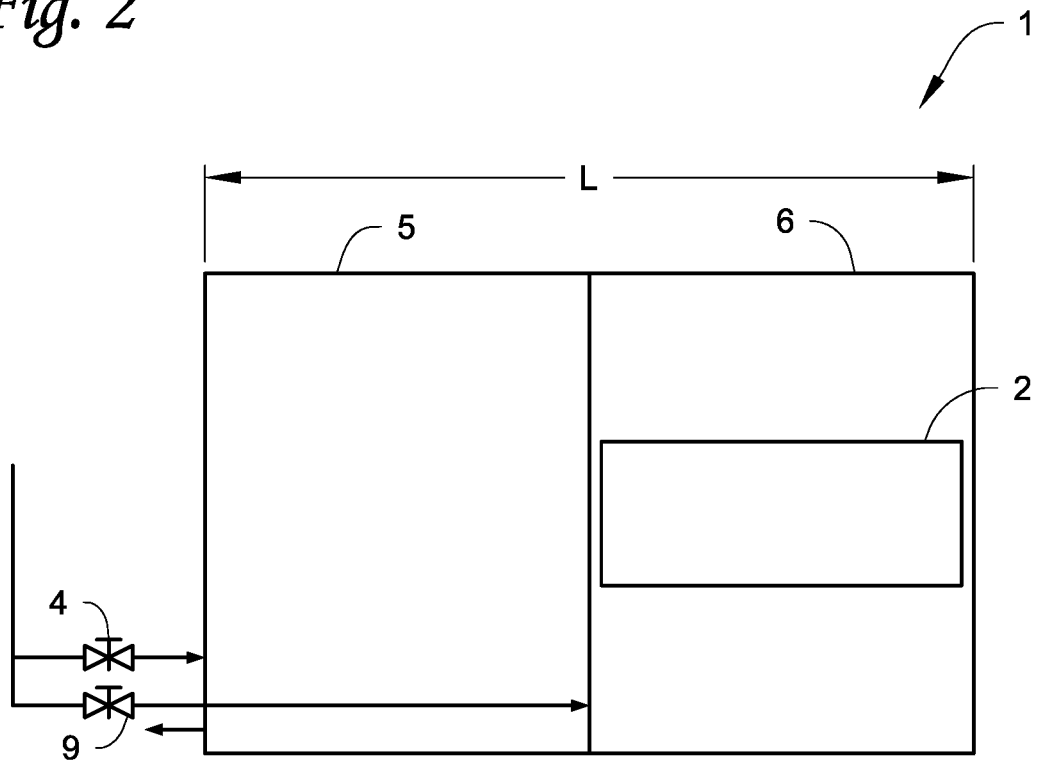
FIG. 2 is a front schematic view of a gas/liquid distribution scheme for a microchannel heat exchanger, according to an embodiment.

FIG. 2 is a front schematic view of a microchannel heat exchanger 1 in an HVAC system, according to an embodiment. In an embodiment, the HVAC system can be a rooftop unit. Flow control devices 4 and 9 are configured to control refrigerant that flows into the microchannel heat exchanger 1. Flow control devices 4 and 9 can be, for example, cutoff orifice, capillary, manual valve, solenoid valve, etc. The arrows extended from the flow control devices 4 and 9 can be a first inlet and a second inlet, respectively. In an embodiment, the first inlet can connect to a first header. The second inlet can connect to a second header. The arrow below the flow control device 9 can be an outlet. In an embodiment, the outlet can connect to an outlet header. The microchannel heat exchanger 1 has a length L. A length of the fan casing 2 is at or about half of L. A fan (not shown) is provided in the fan casing. When looking into the paper, the microchannel heat exchanger 1 is divided into a front area 5 and a back area 6 along or close to a left edge of the fan casing 2. In an embodiment, FIG. 4 can be a structural schematic view of the microchannel heat exchanger of FIG. 2, without the fan casing 2.

Figure 3:
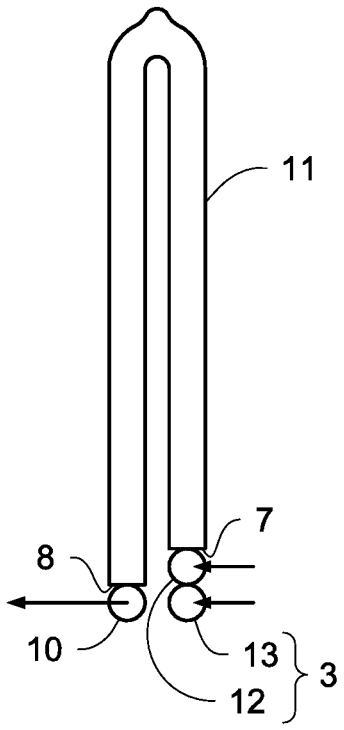
FIG. 3 is a side schematic view of a gas/liquid distribution scheme for a microchannel heat exchanger, according to an embodiment.
Figure 4:
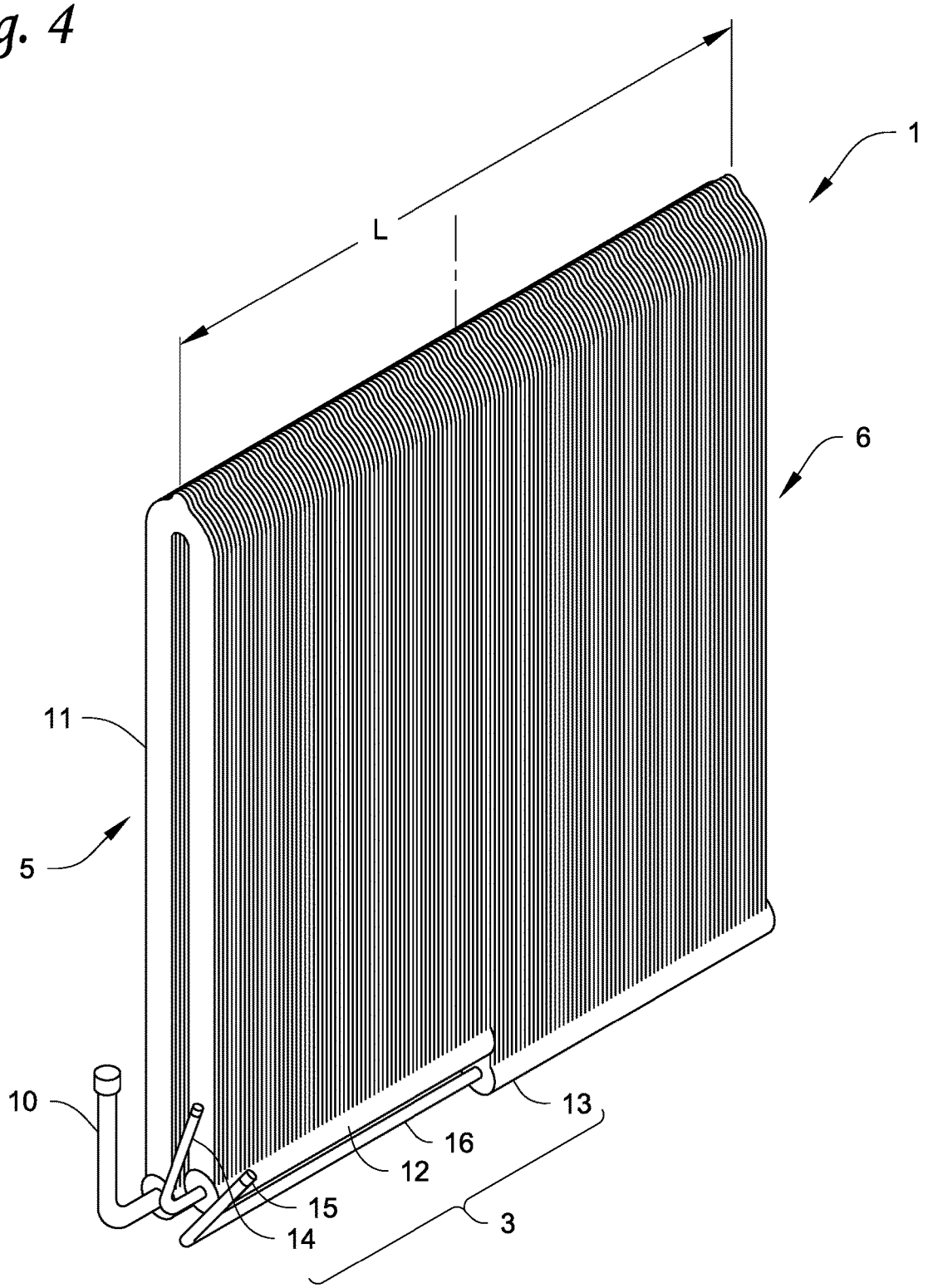
FIG. 4 is a structural schematic view of a microchannel heat exchanger, according to an embodiment.

In FIGS. 2-4, a microchannel heat exchanger 1 includes a plurality of flat tubes 11 arranged successively in a direction along the length L of the microchannel heat exchanger 1. As shown in FIG. 3, each of the flat tubes 11 has microchannels (not shown) or small pathways for gas or liquid (e.g., refrigerant) to pass through. The microchannels have inlets and outlets. The microchannel heat exchanger 1 also includes a gas/liquid distribution structure 3 that is in communication with the inlet 7 of each of the plurality of flat tubes 11. The gas/liquid distribution structure 3 includes an inlet header component (12 and 13). The microchannel heat exchanger further includes an outlet header 10 that is in communication with the outlet 8 of each of the plurality of flat tubes 11. The outlet header 10 is connected on each of the plurality of flat tubes 11. A first inlet header 12 and a second inlet header 13 can be connected to a first part and a second part of the plurality of flat tubes 11, respectively. In an embodiment, connecting is welding. Fan (not shown) is provided and located at a back area 6 of the microchannel heat exchanger 1. The fan has a fan casing 2. The microchannel heat exchanger 1 is divided into a front area 5 and the back area 6 and may be subject to significant wind field differences based on the position of the fan casing 2. As shown by dotted lines in FIGS. 2 and 4, the microchannel heat exchanger 1 is divided into the front area 5 and the back area 6 along or close to the left edge of the fan casing 2.

As shown in FIG. 4, the gas/liquid distribution structure 3 has two inlets (14 and 15) configured to distribute refrigerant to different areas (front area 5 and back area 6) of the microchannel heat exchanger 1, respectively. The two inlets (14 and 15) are configured to allow gas/liquid (e.g., refrigerant) to enter the inlet header component (12 and 13), respectively. The two inlets (14 and 15) are located close to each other toward one side (e.g., front side or back side) of the microchannel heat exchanger 1. As shown, two inlets (14 and 15) are located toward the front (left) side of the microchannel heat exchanger 1. The gas/liquid distribution structure 3 also includes two distribution components (not shown) configured to distribute the gas/liquid to each of the different areas (front area 5 and back area 6) of the microchannel heat exchanger 1. The two distribution components are located in the inlet header component (12 and 13) and connected to the two inlets (14 and 15), respectively. In an embodiment, the distribution component inside the first inlet header 12 is a distribution pipe. In an embodiment, the distribution component inside the second inlet header 13 is a distribution pipe.

In FIG. 4, the inlet header component (12 and 13) includes the first inlet header 12 configured to distribute refrigerant to the front area 5 of the microchannel heat exchanger 1 and the second inlet header 13 configured to distribute refrigerant to the back area 6 of the microchannel heat exchanger 1. The first inlet 14 is connected to a front end of the first inlet header 12. The second inlet 15 is connected to a front end of the second inlet header 13. In an embodiment, the two distribution components are distribution pipes. Specifically, a first distribution pipe (not shown) is provided within the first inlet header 12, and a second distribution pipe (not shown) is provided within the second inlet header 13.

In an embodiment, the first inlet header 12 can be connected to the first part of the plurality of flat tubes 11. The first part of the plurality of flat tubes 11 is located in the front area 5 of the microchannel heat exchanger. A first portion of refrigerant enters the first inlet header 12 via the first inlet 14 of the first inlet header, and is evenly distributed via the first distribution pipe to the microchannels of the first part of the plurality of the flat tubes 11. In an embodiment, connecting is welding.

In an embodiment, the second inlet header 13 can be connected to the second part of the plurality of flat tubes 11. The second part of the plurality of flat tubes 11 is located in the back area 6 of the microchannel heat exchanger. A second portion of refrigerant enters the second inlet header 13 via the second inlet 15 of the second inlet header 13, and is evenly distributed via the second distribution pipe to the microchannels of the second part of the plurality of the flat tubes 11. In FIG. 4, the first inlet header 12 is located above the second inlet header 13. In an embodiment, the second inlet header 13 is located above the first inlet header 12. In an embodiment, connecting is welding.

In FIG. 4, an extension pipe 16 connects the header 13 to the second inlet 15. The structure and arrangement of the extension pipe 16 can help to locate the first inlet 14 of the first inlet header 12 close to the second inlet 15 of the second inlet header 13 toward one side (e.g., front or back side) of the microchannel heat exchanger 1. An advantage of the first inlet 14 being close to the second inlet 15 is that a shared/common inlet (not shown) can easily divide refrigerant into two portions, and each portion is distributed through the first inlet 14 of the first inlet header 12 and the second inlet 15 of the second inlet header 13, respectively.

In an embodiment, the first inlet 14 is located on top of the second inlet 15. In an embodiment, the flat tubes 11 located in the back area 6 can be longer than the flat tubes 11 located in the front area 5.

In an embodiment, a shared inlet of the microchannel heat exchanger 1 can be used. It will be appreciated that the shared inlet is not required. In operation, refrigerant is directed from, for example, an expansion valve, to the shared (or common) inlet of the microchannel heat exchanger 1. The shared inlet is located upstream if the first inlet 14 and the second inlet 15. The refrigerant flow is then divided into a first portion and a second portion. The first portion of refrigerant is directed from the shared inlet to the first inlet 14. The first portion of refrigerant is then directed from the first inlet 14 into the first inlet header 12. In the first inlet header 12, the first portion of refrigerant is evenly distributed to the first part of the plurality of flat tubes 11 via a first distribution component, for example, a distribution pipe. The first part of the plurality of flat tubes 11 are the flat tubes located in the front area 5 of the microchannel heat exchanger 1. In the first part of the plurality of flat tubes 11, the first portion of refrigerant is directed through microchannels of each of the first part of the plurality of flat tubes 11, toward the outlet header 10. In the first part of the plurality of flat tubes 11, heat exchange is conducted between the first portion of refrigerant and a fluid (e.g., air) external to the flat tubes to provide cooling or heating when the first portion of refrigerant flows within the flat tubes.

The second portion of refrigerant is directed from the shared inlet to the second inlet 15. The second portion of refrigerant is then directed from the second inlet 15 into the second inlet header 13. In the second inlet header 13, the second portion of refrigerant is evenly distributed to the second part of the plurality of flat tubes 11 via a second distribution component, for example, a distribution pipe. The second part of the plurality of flat tubes 11 are the flat tubes located in the back area 6 of the microchannel heat exchanger 1. In the second part of the plurality of flat tubes 11, the second portion of refrigerant is directed through microchannels of each of the second part of the plurality of flat tubes 11, toward the outlet header 10. In the second part of the plurality of flat tubes 11, heat exchange is conducted between the second portion of refrigerant and a fluid (e.g., air) external to the flat tubes to provide cooling or heating when the second portion of refrigerant flows within the flat tubes.

The first portion of refrigerant and the second portion of refrigerant are then combined within the outlet header 10 and directed out of the microchannel heat exchanger 1 through an outlet that connects to the outlet header 10.

The gas/liquid distribution structure 3 can carry out the distribution of refrigerant through the microchannel heat exchanger via two or more segments of distribution and has the following characteristics:

1. The distribution of refrigerant flow can be divided into two or more portions. Each distribution portion can be optimized locally and the difficulty of the distribution optimization can be reduced.

2. The microchannel heat exchanger having areas with significant wind field differences can be divided into multiple (e.g., two) portions, the distribution can be done via independent distribution component (for example, distribution pipes), respectively, and the design of refrigerant distribution can be optimized locally for each portion.

3. The flow adjustment/regulation for each of the two or more segments can be controlled by flow control/adjustment/regulation devices (such as cutoff orifice, capillary, manual valve, solenoid valve, etc.) to optimize performance.

4. The two or more segments can share an outlet header.

Embodiment 2

Figure 5:
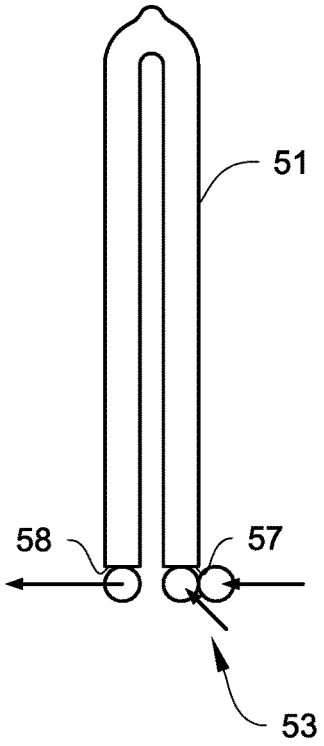
FIG. 5 is a side schematic view of a gas/liquid distribution scheme for a microchannel heat exchanger, according to an embodiment.
Figure 6:
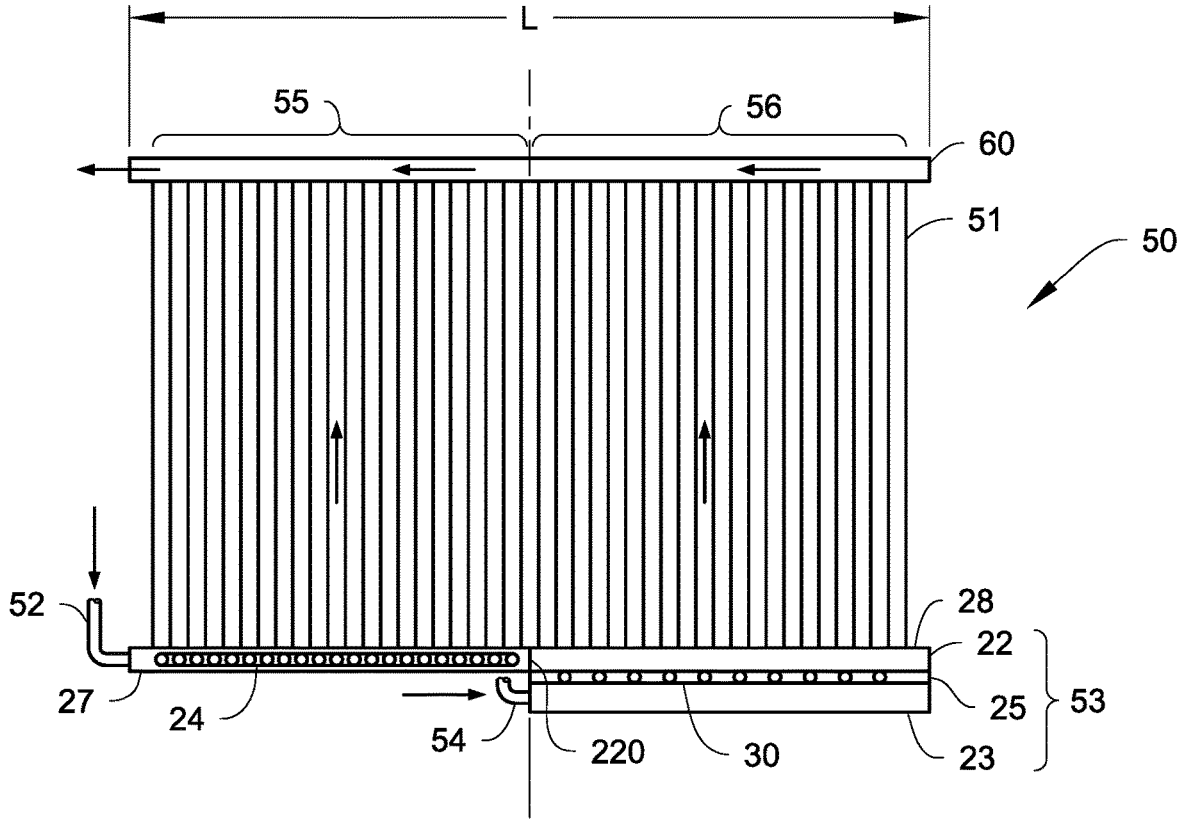
FIG. 6 is a structural schematic view of a microchannel heat exchanger, according to an embodiment.
Figure 7:
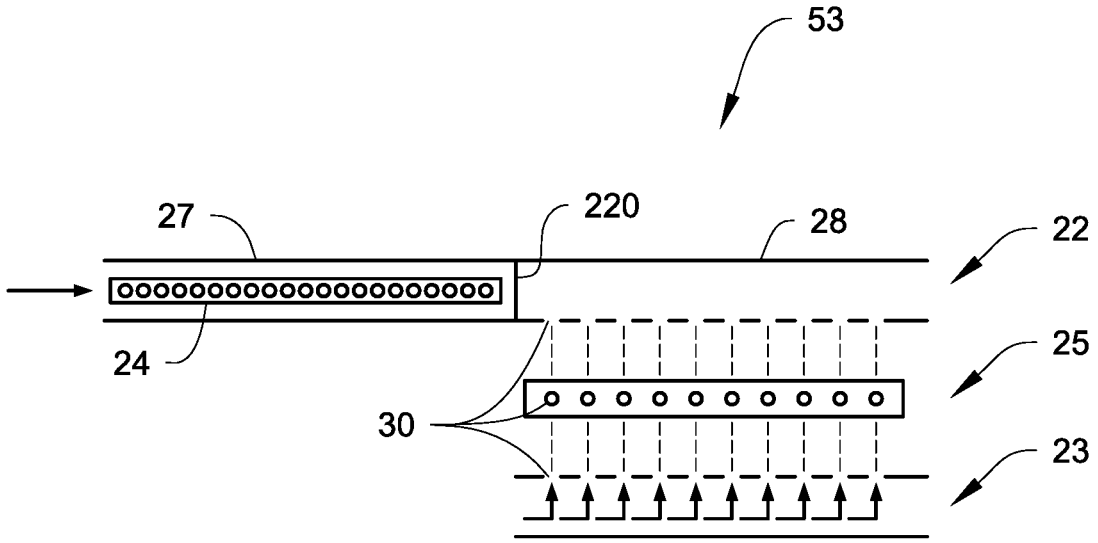
FIG. 7 is an exploded view of a distribution component of a gas/liquid distribution structure, according to an embodiment.

In FIGS. 5-7, a microchannel heat exchanger 50 includes a plurality of flat tubes 51 arranged successively in a direction along a length L of the microchannel heat exchanger 50. Each of the flat tubes 51 has microchannels (not shown) or small pathways for gas or liquid (e.g., refrigerant) to pass through. The microchannels have inlets and outlets. The microchannel heat exchanger 50 also includes a gas/liquid distribution structure 53 that is in fluid communication with the inlet 57 of each of the plurality of flat tubes 51. The microchannel heat exchanger 50 further includes an outlet header 60 that is in communication with the outlet 58 of each of the plurality of flat tubes 51. The gas/liquid distribution structure 53 includes an inlet header component (22 and 23).

Similar to FIGS. 2-4, a fan casing (not shown) can be provided to define a back area 56 of the microchannel heat exchanger 50. The microchannel heat exchanger 50 is divided into a front area 55 and the back area 56 according to significant wind field differences. As shown by dotted lines in FIG. 6, the microchannel heat exchanger 50 is divided into the front area 55 and the back area 56, similar to FIG. 2, along or close to a left edge of the fan casing (not shown).

Accordingly, the gas/liquid distribution structure 53 has two inlets (52 and 54) configured to distribute refrigerant to different areas (front area 55 and back area 56) of the microchannel heat exchanger 50 respectively. The two inlets are configured to allow gas/liquid to enter the inlet header component (22 and 23).

The gas/liquid distribution structure 53 also includes two distribution components configured to distribute the gas/liquid to each of the different areas (front area 55 and back area 56) of the microchannel heat exchanger 50. The two distribution components are located in the inlet header component (22 and 23) and connected to the two inlets (52 and 54), respectively.

In an embodiment, the two inlets can be configured to be located close to each other similar to the inlets 14 and 15 in Embodiment 1. In an embodiment, the two inlets 52, 54 can be configured to be spaced away from each other in a direction along a length L of the microchannel heat exchanger 50. For example, a first inlet is connected to and is located at a front end of the first inlet header 22, and a second inlet is connected to and is located at a front end of the second inlet header 23.

In FIG. 6, the inlet header component (22 and 23) includes a first inlet header 22 and a second inlet header 23. The inlet 57 and outlet 58 of each of the plurality of the flat tubes 51 are connected to the first inlet header 22 and the outlet header 60, respectively. In an embodiment, connecting is welding. In an embodiment, the second inlet header 23 fixedly connects to a back part 28 of the first inlet header 22. In an embodiment, the second inlet header 23 fixedly connects to a back part 28 of the first inlet header 22 via a connector 25. In an embodiment, a partition 220 is provided in the first inlet header 22. The partition 220 divides the first inlet header 22 into a front part 27 and the back part 28. In an embodiment, a first inlet 52 is connected to a front end of the first inlet header 22. The first inlet 52 is in fluid communication with the front part 27 of the first inlet header 22. In an embodiment, a first distribution component (for example, a distribution pipe) 24 is provided in the front part 27. The first distribution pipe 24 is configured to distribute the gas/liquid to the front area 55 of the microchannel heat exchanger 50. In an embodiment, a second inlet 54 is connected to a front end of the second inlet header 23. The second inlet 54 is in fluid communication with the back part 28 of the first inlet header 22. As shown in FIG. 6, the first inlet 52 and the second inlet 54 are spaced away from each other along a length of the first inlet header 22. The first inlet 52 is located at the front (left) side of the microchannel heat exchanger 50. The second inlet 54 is located near the dotted lines that divide the microchannel heat exchanger 50 into the front area 55 and the back area 56. In an embodiment, the second inlet 54 is located near the left end of the second inlet header 23. It will be appreciated that similar to the inlets 14 and 15 in FIG. 4, the first inlet 52 and the second inlet 54 can be located toward one (e.g., front or back) side of the microchannel heat exchanger 50, and an extension pipe can be used to connect the second inlet 54 to the second inlet header 23. A shared inlet can be located upstream of the first and second inlets 52 and 54.

In an embodiment, a second distribution component 30 is provided on the second inlet header 23, the back part 28 of the first inlet header 22, and the connector 25. The second distribution component 30 is a structure that allows refrigerant to flow from the second inlet header 23 to the back part 28 of the first inlet header 22 and allows refrigerant to be evenly distributed from the back part 28 of the first inlet header 22 to the plurality of flat tubes 11 located in the back area 56 of the microchannel heat exchanger 50.

In an embodiment, the second distribution component 30 can be the connector 25. In an embodiment, the connector 25 includes a plurality of distribution openings, and the plurality of distribution openings is sequentially arranged along a length of the connector 25. In an embodiment, the plurality of distribution openings is sequentially arranged in a direction parallel to the length L of the microchannel heat exchanger 50. In an embodiment, the size/diameter of each of the plurality of distribution openings on the connector 25 is at or about 2 millimeters (at or about 0.079 inches). The connector 25 can be used to retrofit an existing microchannel heat exchanger 50. In an embodiment, it can be difficult to provide openings/holes on the existing headers (22 and/or 23) that meet the desired requirements (for example, size/diameter and/or location) of the distribution openings. In an embodiment, the connector 25 can be designed and/or manufactured independently so that the requirements (for example, size/diameter and/or location) of the distribution openings can be met to help evenly distribute refrigerant. The second distribution component 30 is configured to distribute the gas/liquid to a back area 56 of the microchannel heat exchanger 50. In an embodiment, the second inlet header 23 includes a plurality of distribution openings, and the plurality of distribution openings is sequentially arranged along a length of the second inlet header 23 in a direction parallel to the length L of the microchannel heat exchanger 50. In an embodiment, the back part 28 of the first inlet header 22 includes a plurality of distribution openings, and the plurality of distribution openings is sequentially arranged along a length of the first inlet header 22 in a direction parallel to the length L of the microchannel heat exchanger 50. In an embodiment, a size/diameter of the plurality of distribution openings of the back part 28 of the first inlet header 22 and a size/diameter of the plurality of distribution openings of the second inlet header 23 are slightly larger than a size/diameter of the plurality of distribution openings of the connector 25. In an embodiment, the size/diameter of each of the plurality of distribution openings on the back part 28 of the first inlet header 22 is in a range from at or about 4 millimeters (at or about 0.157 inches) to at or about 5 millimeters (at or about 0.197 inches). In an embodiment, the size/diameter of each of the plurality of distribution openings on the second inlet header 23 is in a range from at or about 4 millimeters (at or about 0.157 inches) to at or about 5 millimeters (at or about 0.197 inches). In an embodiment, the first header 22 is made of aluminum. In an embodiment, the first header 23 is made of aluminum. In an embodiment, the plurality of distribution openings of the connector 25, the plurality of distribution openings of the second inlet header 23, and the plurality of distribution openings of the back part 28 of the first inlet header 22 are aligned with each other: each of the plurality of distribution openings on the connector 25 is within each of the plurality of distribution openings on the back part 28 of the first inlet header 22 when viewed in a direction from the distribution openings on the connector 25 to the distribution openings on the back part 28, respectively; and each of the plurality of distribution openings on the connector 25 is within each of the plurality of distribution openings on the second inlet header 23 when viewed in a direction from the distribution openings on the connector 25 to the distribution openings on the second inlet header 23, respectively. This alignment can help refrigerant to be evenly distributed through the distribution openings on the pre-designed and/or pre-manufactured connector 25. The bigger size/diameter of the distribution openings on the back part 28 of the first inlet header 22 and the second inlet header 23 can help to prevent the distribution openings on the connector 25 from being blocked by, for example, the non-opening area of the first inlet header 22 and the second inlet header 23, and/or the connecting material that is used to connect the back part 28 of the first inlet header 22 to the connector 25 and to connect the connector 25 to the second inlet header 23. In an embodiment, connecting is welding.

It would be appreciated that in some embodiments, the connector 25 may not be required. In an embodiment, the second distribution component 30 can be the back part 28 of the first inlet header 22 and its distribution openings. In an embodiment, the size/diameter of the distribution openings of the second header 23 can be larger than the size/diameter of the distribution openings of the first header 22. In an embodiment, each of the distribution openings of the first header 22 is located within each of the distribution openings of the second header 23 when viewed in a direction from the distribution openings of the first header 22 to the distribution openings of the second header 23, respectively. In an embodiment, the second header 23 can have a large opening so that all of the distribution openings of the first header 22 are located within the large opening of the second header 23 when viewed in a direction from the distribution openings of the first header 22 to the large opening of the second header 23.

In an embodiment, the second distribution component 30 can be the second inlet header 23 and its distribution openings. In an embodiment, the size/diameter of the distribution openings of the first header 22 can be larger than the size/diameter of the distribution openings of the second header 23. In an embodiment, each of the distribution openings of the second header 23 is located within each of the distribution openings of the first header 22 when viewed in a direction from the distribution openings of the second header 23 to the distribution openings of the first header 22, respectively. In an embodiment, the first header 22 can have a large opening so that all of the distribution openings of the second header 23 are located within the large opening of the first header 22 when viewed in a direction from the distribution openings of the second header 23 to the large opening of the first header 22.

The second inlet header 23 can be directly connected to the back part 28 of the first inlet header 22. In an embodiment, connecting is welding. In an embodiment, the second inlet header 23 can be connected at any angle at any position on the external surface of the back part 28 of the first inlet header 22. In an embodiment, the second inlet header 23 can be connected at any angle at any position on the external surface of the back part 28 of the first inlet header 22 via the connector 25.

An advantage of this embodiment is being able to retrofit an existing microchannel heat exchanger with minimum drills (for example, drilling openings on the back part 28 of the first inlet header 22 and the second inlet header 23) and connects (for example, to connect the connector 25 to the back part 28 of the first inlet header 22 and to connect the connector to the second inlet header). In an embodiment, connecting is welding. It will be appreciated that drilling holes on the headers is typically a simple process that requires simple tools. In an embodiment, the back part 28 of the first inlet header 22 can be cut into a large opening (so that all distribution openings of the connector 25 are within the large opening of the back part 28 of the first inlet header 22 when viewed in a direction from the distribution openings of the connector 25 to the large opening of the first header 22) instead of a plurality of openings/holes. In an embodiment, the second inlet header 23 can be cut into a large opening (so that all distribution openings of the connector 25 are within the large opening of the second inlet header 23 when viewed in a direction from the distribution openings of the connector 25 to the large opening of the second header 23) instead of a plurality of openings/holes. It will be appreciated that cutting the first inlet header 22 and/or the second inlet header 23 into large opening(s) might require different/more tools, and the space for connecting (e.g., welding) might be limited (i.e., harder for welding process).

Another advantage of this embodiment is the first inlet 52 being close to the second inlet 54 is retrofitted with minimum structural changes to the microchannel heat exchanger 50. An advantage of the first inlet 52 being close to the second inlet 54 toward one side (e.g., front side) of the microchannel heat exchanger 50 is that in an existing heat exchanger, an inner space/room at the other side (e.g., back side) of the microchannel heat exchanger 50 is relatively small (e.g. packed with two coils side by side) and is not enough for a retrofit of the microchannel heat exchanger 50 at the other side (e.g., back side).

A first portion of refrigerant enters a front part 27 of the first inlet header 22 via the first inlet, and is evenly distributed via the first distribution pipe 24 to the microchannels of a first part of the plurality of the flat tubes 51. The first part of the plurality of the flat tubes 51 is located in the front area 55 of the microchannel heat exchanger 50. A second portion of refrigerant enters the second inlet header 23 via the second inlet, and is evenly distributed via the second distribution component 30 to the microchannels of a second part of the plurality of the flat tubes 51. The second part of the plurality of the flat tubes 51 is located in the back area 56 of the microchannel heat exchanger 50.

In an embodiment, a shared inlet of the microchannel heat exchanger 50 can be used. The shared inlet is located upstream of the first and the second inlet 52 and 54. A first portion of refrigerant can be directed from the shared inlet to the first inlet 52, and a second portion of refrigerant can be directed from the shared inlet to the second inlet 54. It will be appreciated that shared inlet is not required. In operation, refrigerant is directed from, for example, an expansion valve, to the shared (or common) inlet of the microchannel heat exchanger 50. The refrigerant flow is then divided into a first portion and a second portion. The first portion of refrigerant is directed from the shared inlet to the first inlet 52. The first portion of refrigerant is then directed from the first inlet 52 into the front part 27 of the first inlet header 22. The front part 27 of the first inlet header 22 is not in fluid communication with the back part 28 of the first inlet header 22 because the partition 220 blocks the refrigerant flow. In the front part 27 of the first inlet header 22, the first portion of refrigerant is evenly distributed to the first part of the plurality of flat tubes 51 via the first distribution component 24, for example, a distribution pipe. The first part of the plurality of flat tubes 51 are the flat tubes located in the front area 55 of the microchannel heat exchanger 50. In the first part of the plurality of flat tubes 51, the first portion of refrigerant is directed through microchannels of each of the first part of the plurality of flat tubes 51, toward the outlet header 60. In the first part of the plurality of flat tubes 51, heat exchange is conducted between the first portion of refrigerant and a fluid (e.g., air) external to the flat tubes to provide cooling or heating when the first portion of refrigerant flows within the flat tubes.

The second portion of refrigerant is directed from the shared inlet to the second inlet 54. The second portion of refrigerant is then directed from the second inlet 54 into the second inlet header 23.

In an embodiment, the back part 28 of the first inlet header 22 has a plurality of distribution openings. In an embodiment, the second inlet header 23 has a plurality of distribution openings. In an embodiment, the connector 25 has a plurality of distribution openings. In an embodiment, the number of distribution openings on the back part 28 of the first inlet header 22, the second inlet header 23, and the connector 25 is the same. In an embodiment, each of the plurality of distribution openings on the back part 28 of the first inlet header 22, the second inlet header 23, and the connector 25 are aligned with each other. For example, a first distribution opening on the back part 28 of the first inlet header 22 is located at (or almost) the same location as a first distribution opening on the second inlet header 23 and a first distribution opening on the connector 25. Refrigerant can flow, for example, from second inlet header 23 through the first distribution opening on second inlet header 23 to the first distribution opening on the connector 25, and then from the first distribution opening on the connector 25 through the first distribution opening on the back part 28 of the first inlet header 22 to the back part 28 of the first inlet header 22. In an embodiment, each of the plurality of distribution openings on the back part 28 of the first inlet header 22, the second inlet header 23, and the connector 25 are aligned with each other.

The second portion of refrigerant is evenly distributed to the second part of the plurality of flat tubes 51 via the second distribution component 30. In an embodiment, the second distribution component 30 can be the connector 25 and its distribution openings. In an embodiment, the second distribution component 30 can be the back part 28 of the first inlet header 22 and its distribution openings. In an embodiment, the second distribution component 30 can be the second inlet header 23 and its distribution openings. The second part of the plurality of flat tubes 51 are the flat tubes located in the back area 56 of the microchannel heat exchanger 50. In the second part of the plurality of flat tubes 51, the second portion of refrigerant is directed through microchannels of each of the second part of the plurality of flat tubes 51, toward the outlet header 60. In the second part of the plurality of flat tubes 51, heat exchange is conducted between the second portion of refrigerant and a fluid (e.g., air) external to the flat tubes 51 to provide cooling or heating when the second portion of refrigerant flows within the flat tubes 51.

The first portion of refrigerant and the second portion of refrigerant are then combined within the outlet header 60 and directed out of the microchannel heat exchanger 50 through an outlet that connects to the outlet header 60.

FIG. 7 shows an exploded view of a distribution component 30 of a gas/liquid distribution structure 53, according to an embodiment. The partition 220 divides the first inlet header 22 into the front part 27 and the back part 28. The first distribution component 24 (for example, a distribution pipe) is located in the front part 27 of the first inlet header 22. The back part 28 includes a plurality of distribution openings.

In an embodiment, the connector 25 includes a plurality of distribution openings. In an embodiment, the connector 25 is a flat piece having a length that is the same or about the same as a length of the back part 28 of the first inlet header 22, so that refrigerant can be evenly distributed to the second part of the plurality of flat tubes 51. In an embodiment, the connector 25 can be made of material that is the same or about the same as a distribution pipe. A first side of the connector 25 can be connected to the back part 28 of the first inlet header 22. In an embodiment, the first side of the connector 25 has a shape that corresponds to a shape of a portion of an outer surface of the back part 28 of the first inlet header 22, so that when connecting the first side of the connector 25 onto the back part 28 of the first inlet header 22, there is no gap or nearly no gap in between. In an embodiment, a second side of the connector 25 can be connected to the second inlet header 23. The length of the connector 25 is the same or about the same as a length of the second inlet header 23 so that refrigerant can be evenly distributed to the second part of the plurality of flat tubes 51. In an embodiment, the second side of the connector 25 has a shape that corresponds to a shape of a portion of an outer surface of the second inlet header 22, so that when connecting the second side of the connector 25 onto the second inlet header 23, there is no gap or nearly no gap in between. In an embodiment, connecting is welding. In an embodiment, the parameters (e.g., size/diameter, material, shape, length, etc.) of the second inlet header 23 can be the same or about the same as the parameters of the back part 28 of the first inlet header 22. The second inlet header 23 includes a plurality of distribution openings. In an embodiment, a size of the plurality of distribution openings of the first inlet header 22 and a size of the plurality of distribution openings of the second inlet header 23 are slightly larger than a size of the plurality of distribution openings of the connector 25.

The plurality of distribution openings of the connector 25, the plurality of distribution openings of the second inlet header 23, and the plurality of distribution openings of the back part 28 of the first inlet header are aligned with each other when the connector 25 is connected on the back part 28 of the first inlet header and on the second inlet header 23. In an embodiment, connecting is welding.

In an embodiment, the second distribution component 30 includes the connector 25 and its distribution openings. In an embodiment, the second distribution component 30 includes the second inlet header 23 and its distribution openings. In an embodiment, the second distribution component 30 includes the back part 28 of the first inlet header 22 and its distribution openings.

In an embodiment, a conventional distribution component (for example, a distribution pipe) can be provided in the back part 28 of the first inlet header 22, the second inlet 54 can be in communication with the back part 28 of the first inlet header 22, and the conventional distribution component can be configured to distribute the gas/liquid to the back area 56 of the microchannel heat exchanger 50. In such embodiment, an opening on the back part 28 of the first inlet header 22 can be included for the second inlet 54 to communicate with the back part 28 of the first inlet header 22. In such embodiment, the second inlet header 23 and/or the connector 25 are not needed, and no distribution openings on the back part 28 of the first inlet header 22 are needed.

The gas/liquid distribution structure 53 can carry out the distribution of refrigerant through the microchannel heat exchanger via two or more segments of distribution and has the following characteristics:

1. The distribution of refrigerant flow can be divided into two or more portions. Each distribution portion can be optimized locally and the difficulty of the distribution optimization can be reduced.

2. The microchannel heat exchanger having areas with significant wind field differences can be divided into multiple (e.g., two) portions, the distribution can be done via independent distribution component (for example, distribution pipes), respectively, and the design of refrigerant distribution can be optimized locally for each portion.

3. The flow adjustment/regulation for each of the two or more segments can be controlled by flow control/adjustment/regulation devices (such as cutoff orifice, capillary, manual valve, solenoid valve, etc.) to optimize performance.

4. The microchannel heat exchanger can be retrofitted with minimum structural changes and minimum processes/tools.

5. The two or more segments can share an outlet header.

The above embodiments are merely illustrative of the technical concept and features of the gas/liquid distribution structure, and these embodiments are to make a person skilled in the art understand the contents of the gas/liquid distribution structure and to implement the gas/liquid distribution structure without limiting the scope of protection of the gas/liquid distribution structure. Any features described in the first embodiment can be combined with or incorporated/used into the second embodiment, and vise versa. The equivalent change or modification according to the substance of the gas/liquid distribution structure should be covered by the scope of protection of the gas/liquid distribution structure.

What is claimed is:

1. A microchannel heat exchanger comprising:

a plurality of flat tubes;

a refrigerant distribution structure; and an outlet header, wherein the plurality of flat tubes is arranged successively in a direction along a length of the microchannel heat exchanger, each of the plurality of flat tubes includes microchannels, the plurality of flat tubes includes inlets and outlets, the inlets of the plurality of flat tubes are in fluid communication with the outlets of the plurality of flat tubes through the microchannels of the plurality of flat tubes, the outlet header is in fluid communication with outlets of the plurality of flat tubes, the plurality of flat tubes is divided into a first part of flat tubes and a second part of flat tubes, the first part of flat tubes is configured to be subject to a first wind field, the second part of flat tubes is configured to be subject to a second wind field, the refrigerant distribution structure includes a first inlet header and a second inlet header, the first inlet header has a first end and a second end, the second inlet header has a first end and a second end, the first inlet header is in fluid communication with inlets of the first part of flat tubes, the second inlet header is in fluid communication with inlets of the second part of flat tubes; and the refrigerant distribution structure further includes a first inlet connected to the first end of the first inlet header, a second inlet connected to the first end of the second inlet header, a first distributor, and a second distributor, the first inlet of the refrigerant distribution structure is in fluid communication with the first inlet header and the first distributor, the second inlet of the refrigerant distribution structure is in fluid communication with the second inlet header and the second distributor, the first distributor and the second distributor are configured to control refrigerant flow independently, the first distributor is different from the second distributor in order to locally control refrigerant flow corresponding to the first wind field of the first part of flat tubes and the second wind field of the second part of flat tubes, and the first wind field is different from the second wind field, wherein the first distributor is a distribution pipe, and the first distributor is located in the first inlet header, wherein the refrigerant distribution structure further includes a partition in the first inlet header, the partition divides the first inlet header into a first part and a second part, the first distributor is located in the first part of the first inlet header, the second part of the first inlet header includes a plurality of distribution openings, the second inlet header includes a plurality of distribution openings, the first inlet header connects to the plurality of flat tubes, and the second distributor includes the plurality of distribution openings of the second part of the first inlet header and the plurality of distribution openings of the second inlet header, wherein the refrigerant distribution structure further includes a connector, the second inlet header fixedly connects to the second part of the first inlet header via the connector, the connector includes a plurality of distribution openings, a size of each of the plurality of distribution openings of the second part of the first inlet header is larger than a size of each of the plurality of distribution openings of the connector, a size of each of the plurality of distribution openings of the second inlet header is larger than the size of each of the plurality of distribution openings of the connector, and the second distributor includes the plurality of distribution openings of the connector.

2. A refrigeration circuit, comprising:

a microchannel heat exchanger; and a fan casing, wherein the microchannel heat exchanger comprises:

a plurality of flat tubes;

a refrigerant distribution structure; and an outlet header, wherein the plurality of flat tubes is arranged in a direction along a length of the microchannel heat exchanger, each of the plurality of flat tubes includes microchannels, the plurality of flat tubes includes inlets and outlets, the inlets of the plurality of flat tubes are in fluid communication with the outlets of the plurality of flat tubes through the microchannels of the plurality of flat tubes, the outlet header is in fluid communication with outlets of the plurality of flat tubes, the plurality of flat tubes is divided into a first part of flat tubes and a second part of flat tubes, the first part of flat tubes is configured to be subject to a first wind field, the second part of flat tubes is configured to be subject to a second wind field, the fan casing is positioned in front of the second part of flat tubes, the fan casing is not positioned in front of the first part of flat tubes, the refrigerant distribution structure includes a first inlet header and a second inlet header, the first inlet header has a first end and a second end, the second inlet header has a first end and a second end, the first inlet header is in fluid communication with inlets of the first part of flat tubes, the second inlet header is in fluid communication with inlets of the second part of flat tubes; and the refrigerant distribution structure further includes a first inlet connected to the first end of the first inlet header, a second inlet connected to the first end of the second inlet header, a first distributor, and a second distributor, the first inlet of the refrigerant distribution structure is in fluid communication with the first inlet header and the first distributor, the second inlet of the refrigerant distribution structure is in fluid communication with the second inlet header and the second distributor, the first distributor and the second distributor are configured to control refrigerant flow independently, the first distributor is configured to locally control refrigerant flow corresponding to the first wind field of the first part of flat tubes, the second distributor is configured to locally control refrigerant flow corresponding to the second wind field of the second part of flat tubes, and the first wind field is different from the second wind field.

3. The refrigeration circuit according to claim 2, wherein the first distributor is a distribution pipe, and the first distributor is located in the first inlet header.

4. The refrigeration circuit according to claim 3, wherein the refrigerant distribution structure further includes a partition in the first inlet header, the partition divides the first inlet header into a first part and a second part, the first distributor is located in the first part of the first inlet header, the second part of the first inlet header includes a plurality of distribution openings, the second inlet header includes a plurality of distribution openings, the first inlet header fixedly connects to the plurality of flat tubes, and the second distributor includes the plurality of distribution openings of the second part of the first inlet header and the plurality of distribution openings of the second inlet header.

5. The refrigeration circuit according to claim 4, wherein the refrigerant distribution structure further includes a connector, the second inlet header fixedly connects to the second part of the first inlet header via the connector, the connector includes a plurality of distribution openings, a size of each of the plurality of distribution openings of the second part of the first inlet header is larger than a size of each of the plurality of distribution openings of the connector, a size of each of the plurality of distribution openings of the second inlet header is larger than the size of each of the plurality of distribution openings of the connector, and the second distributor includes the plurality of distribution openings of the connector.

6. The refrigeration circuit according to claim 5, wherein the first part of the first inlet header is not in fluid communication with the second inlet header, and the second part of the first inlet header is in fluid communication with the second inlet header.

* * * * *